US012303981B2

(12) United States Patent
Buettner et al.

(10) Patent No.: US 12,303,981 B2
(45) Date of Patent: May 20, 2025

(54) METHOD FOR PRODUCING AN OPEN-PORED MOLDED BODY WHICH IS HAS A MODIFIED SURFACE AND WHICH IS MADE OF A METAL

(71) Applicants: Alantum Europe GmbH, Munich (DE); Fraunhofer-Gesellschaft zur Foerderung Der Angewandten Forschung e.V., Munich (DE)

(72) Inventors: Tilo Buettner, Dresden (DE); Gunnar Walther, Dresden (DE); Hans-Dietrich Boehm, Dresden (DE); Thomas Weissgaerber, Dresden (DE); Bernd Kieback, Possendorf (DE); Christian Immanuel Mueller, Dresden (DE); Robin Kolvenbach, Munich (DE); Lars Torkuhl, Munich (DE)

(73) Assignees: ALANTUM EUROPE GMBH, Munich (DE); FRAUNHOFER-GESELLSCHAFT ZUR FOERDERUNG DER ANGEWANDTEN FORSCHUNG B.V., Munich (DE)

( * ) Notice: Subject to any disclaimer, the term of this patent is extended or adjusted under 35 U.S.C. 154(b) by 280 days.

(21) Appl. No.: 16/648,062

(22) PCT Filed: Sep. 14, 2018

(86) PCT No.: PCT/EP2018/074883
§ 371 (c)(1),
(2) Date: Mar. 17, 2020

(87) PCT Pub. No.: WO2019/057625
PCT Pub. Date: Mar. 28, 2019

(65) Prior Publication Data

US 2020/0276644 A1 Sep. 3, 2020

(30) Foreign Application Priority Data

Sep. 19, 2017 (DE) ..... 10 2017 216 566.9

(51) Int. Cl.
*B22F 7/00* (2006.01)
*C22C 1/08* (2006.01)
*C25D 5/56* (2006.01)

(52) U.S. Cl.
CPC ..... *B22F 7/002* (2013.01); *C22C 1/08* (2013.01); *B22F 2301/052* (2013.01);
(Continued)

(58) Field of Classification Search
CPC ..... B01J 37/0009; B01J 37/0018; B01J 37/0027; B01J 37/0036; B01J 37/0045; B01J 37/0054; B01J 37/0063; C22C 1/08; C22C 2001/083; C22C 2001/085; C22C 2001/086; C22C 2001/087; C22C 2001/088; H01M 4/0416; H01M 4/80; H01M 4/801; H01M 4/803; H01M 4/805; H01M 4/806; H01M 4/808; H01M 4/8605; H01M 4/861; H01M 4/8615; H01M 4/8621; H01M 4/8626; H01M 4/8631; H01M 4/8842; H01M 4/8846; H01M 4/885; H01M 4/886; H01M 4/8885; H01M 8/023; H01M 8/0232; C23C 8/60; C23C 8/62; C23C 8/72; C23C 8/78; C23C 8/80; C23C 10/28; C23C 10/30; C23C 10/60; C23C 20/00; C23C 20/02; C23C 20/04; C23C 20/06; C23C 24/00; C23C 24/08; C23C 24/082;
(Continued)

(56) References Cited

U.S. PATENT DOCUMENTS

2005/0069648 A1 3/2005 Maruyama
2006/0058185 A1* 3/2006 Cendak ..... B01J 19/0046 502/326

(Continued)

FOREIGN PATENT DOCUMENTS

CN 101184566 5/2008
CN 102186576 9/2011

(Continued)

OTHER PUBLICATIONS

Warzell III, Roland, "Production Sintering Practices," ASM Handbook, vol. 7, Powder Metallurgy, ASM International, 2015, pp. 337-346. (Year: 2015).*

(Continued)

*Primary Examiner* — Vanessa T. Luk
(74) *Attorney, Agent, or Firm* — Jacobson Holman PLLC

(57) ABSTRACT

The invention relates to a method for producing open-pore molded metal bodies which have a modified surface. The surface of an open-pore molded metal body said molded body being used as a semi-finished product, is coated with particles of a chemical compound of a metal on particles of the metal which can be reduced or thermally or chemically decomposed in a thermal treatment. After the coating process, at least one thermal treatment is carried out, in which the produced metal particles are connected to the surface of the semi-finished product and/or adjacent produced particles via sintered necks or sintered bridges such that the specific surface area of the obtained open-pore molded body is increased to at least 30 $m^2/l$ and/or at least by a factor of 5 in comparison to the starting material of the uncoated metal semi-finished product.

9 Claims, No Drawings

(52) U.S. Cl.
CPC ..... *B22F 2301/10* (2013.01); *B22F 2301/30* (2013.01); *C25D 5/56* (2013.01)

(58) Field of Classification Search
CPC ..... C23C 24/085; C23C 24/10; C23C 24/103; C23C 24/106; C23C 26/00; C23C 26/02; B22F 3/001; B22F 3/11; B22F 3/1103; B22F 3/1109; B22F 3/1112; B22F 3/1115; B22F 3/1118; B22F 3/1121; B22F 3/1125; B22F 3/1134; B22F 3/1137; B22F 3/114; B22F 3/1143; B22F 3/1146; B22F 2003/1128; B22F 2003/1131; B22F 7/002; B22F 7/004; B22F 7/006; B22F 7/008; B22F 7/02; B22F 7/04; B22F 7/08; B22F 2007/042; B22F 2007/045; B22F 2007/047; B22F 2201/01; B22F 2201/013; B22F 2201/016; B22F 2303/20; B22F 2303/25; B22F 2301/00; B22F 2301/10; B22F 2301/05; B22F 2301/052; B22F 2301/30; B22F 2302/25; B22F 2302/253; B22F 2302/256
See application file for complete search history.

(56) References Cited

U.S. PATENT DOCUMENTS

| | | | | |
|---|---|---|---|---|
| 2006/0280637 | A1* | 12/2006 | Naumann | B22F 7/006 419/2 |
| 2008/0031767 | A1* | 2/2008 | Naumann | B22F 3/1146 420/457 |
| 2009/0217691 | A1* | 9/2009 | Schmidt | F28F 3/12 62/271 |
| 2014/0221700 | A1* | 8/2014 | Radivojevic | B01J 37/0018 568/885 |

FOREIGN PATENT DOCUMENTS

| | | | | |
|---|---|---|---|---|
| CN | 103966473 | | 8/2014 | |
| CN | 105848811 | | 8/2016 | |
| DE | 3816337 | A1 * | 11/1989 | B22F 1/10 |
| DE | 102009015176 | | 7/2001 | |
| DE | 10150948 | | 5/2003 | |
| DE | 102004032089 | | 12/2005 | |
| DE | 102005010248 | | 8/2006 | |
| DE | 102007027837 | | 12/2008 | |
| DE | 102006039586 | | 5/2009 | |
| EP | 2764916 | | 2/2013 | |
| EP | 3016189 | | 4/2014 | |
| EP | 3333947 | | 7/2016 | |
| JP | 2003064404 | | 3/2003 | |
| JP | 2016513173 | | 5/2016 | |
| JP | 2017033917 | | 2/2017 | |
| WO | 2017026291 | | 5/2018 | |

OTHER PUBLICATIONS

Chinese Office Action Appl. No. 2018800609923, issued Sep. 2, 2021.

European Office Action Appl. No. 18769696.8, date Sep. 24, 2021.

Byung Il Choi et al. Results of round robin test for specific surface area. Analytical Science and Technology, vol. 24, No. 6, Dec. 25, 2011, pp. 503-509.

Joannes W. M. Osterrieth et al. How reproducible are surfaces calculated from the BET I equation?, pp. 1-10, XP055842433. https://chemrixiv.org/engage/api-gateway/chemrxiv/assets/orp/resource/item/60c759380f50db32cb3985c0/original/how-how-reproducible-are-surface-areas-calculated-from-the-bet-equation.pdf.

International Search Report PCT/EP2018/074883, completion date Nov. 8, 2018.

German Office Action File No. 10 2017 216 566.9, date May 29, 2018.

European Office Action and English Translation Application No. 18769696.8, dated Aug. 30, 2022.

Japanese Office Action (and English translation) Appl. No. 2020-516674, mail date: Sep. 20, 2022.

* cited by examiner

METHOD FOR PRODUCING AN OPEN-PORED MOLDED BODY WHICH IS HAS A MODIFIED SURFACE AND WHICH IS MADE OF A METAL

BACKGROUND OF THE INVENTION

The invention relates to a process for producing an open-pored molded or open-pored shaped body having a modified surface comprising metal and a shaped body produced by the process.

Coating of porous metallic molded bodies on their surface, in particular, to improve the properties is known. For this purpose, use is customarily made of pulverulent materials which are applied by means of a binder or a suspension to surfaces of the molded body and organic constituents are removed in a heat treatment and a coating or a surface region which has a different chemical composition than the material of which the shaped body was made can then be formed on surfaces of the shaped body at elevated temperatures.

The specific surface area of a shaped body can also be increased by means of these known possibilities, but this was possible to only a limited extent by means of the known possibilities.

However, very large specific surface areas are advantageous for many industrial applications, and is very desirable in, for example, catalytically assisted processes, filtration or in electrodes in electrochemical applications.

In addition, also influencing other properties on surfaces of open-pored shaped bodies, as far as their properties are concerned, is frequently also wished.

SUMMARY OF THE INVENTION

It is therefore an object of the invention to provide open-pored molded bodies which are composed of a metallic material and can have an increased specific surface area and also other surface properties than it is possible with the base material of which a surface-modified open-pored molded body is made.

This object is achieved according to the invention by a process having the features of the claims which relate to a molded body produced by the process. Advantageous embodiments and further developments can be realized by means of the features in the dependent claims.

In the invention, open-pored bodies composed of a metallic material are used as semifinished part. These can be a metal grid, a metal mesh, a woven metal fabric, a metal foam, a metal wool or a semifinished part comprising metallic fibers.

However, the semifinished part can advantageously also be an open-pored molded body in which a polymer material has been electrochemically coated with a metal. A semifinished part produced in this way can be subjected to a thermal treatment in which the organic constituents of this polymer are removed as a result of pyrolysis. However, this removal of organic components can also occur later in a simultaneous removal of a binder, which will be discussed in more detail below.

In one embodiment of the invention, this thermal treatment is preceded or followed by coating of the open-pored body with particles of a chemical compound of a metal on surfaces of the open-pored molded body comprising metal which has been obtained. Here, the particles should also be introduced into the interior of the shaped body, i.e. into the pores or voids of the semifinished part.

The particles of a chemical compound of a metal can be used as powder, as powder mixture, as suspension or as dispersion for the coating operation. Coating of the surface of the semifinished part with a powder, a powder mixture and/or a suspension/dispersion can be carried out by dipping, spraying, in a pressure-assisted manner, electrostatically and/or magnetically.

In further alternatives according to the invention, the powders, powder mixtures, suspensions or dispersions used for coating the open-porous semifinished part can contain not only particles of a chemical compound of a metal but also an inorganic and/or organic binder which is mixed in finely divided form as a solid powder into the powder, the powder mixture, the suspension or dispersion or is present dissolved in a liquid phase of a solution, the suspension/dispersion of metallic particles or particles of a chemical compound of a metal.

Coating of the surface of the semifinished part with a binder in the form of a solution or a suspension/dispersion can be effected by dipping or spraying. The thus prepared open-pored shaped body, as semifinished part, is coated with a powder of a chemical compound of a chemical element. This powder contains a chemical compound which can be converted in a thermal treatment by chemical reduction or thermal or chemical decomposition into a metal.

The distribution of powder particles on surfaces which have been wetted with the liquid binder and also the adhesion of the particles to the surface can be improved by action of mechanical energy, in particular vibration.

The application of particles as powder, powder mixture and/or suspension/dispersion can be repeated a number of times, preferably at least three times, particularly preferably at least five times. This also applies to the vibration to be carried out in each case and optionally the application of a binder.

Coating of the surface of the semifinished part can, however, also be carried out before the thermal treatment in which the organic constituents of the polymeric material with the aid of which the semifinished part has been produced are removed. After application of the particle-containing material, a thermal treatment in which organic and volatile constituents of the polymeric material and at the same time any binder used are removed is carried out.

After thermal treatment and application of particles, sintering in which sinter necks or sinter bridges between the particles of the metal particles which are formed in the thermal treatment and have been formed in the reduction or decomposition and the metallic surface of the open-pored metallic molded body are formed is carried out.

Here, the specific surface area of the open-pored molded body which has been coated and sintered in this way should be increased to at least 30 $m^2/l$ but at least by a factor of 5 compared to the starting material of the uncoated metallic shaped body as semifinished part.

Here, the porous basic framework having a pore size in the range from 450 μm to 6000 μm and a specific surface area of 1 $m^2/l$-30 $m^2/l$ should be filled with particles (particle size $d_{50}$ in the range from 0.1 μm to 250 μm), depending on the application either from one side (porosity gradient) or completely or the struts of the porous metallic molded body should have been coated on the surface.

Coating with particles can be carried out using different amounts on different sides of the surface, in particular on surfaces of the semifinished part which are arranged opposite one another, in order to obtain a different porosity, pore size and/or specific surface area in each case. This can, for example, be achieved by a different number of applications of particles as powder, powder mixture or in suspension/dispersion, with or without use of binder, on the surfaces arranged on different sides. A gradated formation of a shaped body produced according to the invention can also be achieved in this way.

The pore size within the applied particle layer of the coated and sintered open-pored molded body corresponds to not more than 10,000 times the particle size used. This can be additionally influenced by the maximum sintering temperature and the hold time at this temperature since mass transfer by diffusion and thus sintering, which is associated with a decrease in the pore volume, is promoted with increasing temperature and hold time.

The material of which the molded body produced according to the invention is made should contain not more than 3% by mass, preferably not more than 1% by mass, of $O_2$. Preference is for this purpose given to an inert or reducing atmosphere while carrying out the thermal treatment for removing organic components, the chemical reduction which is optionally to be carried out and/or the sintering.

In a thermal or chemical decomposition, a suitable atmospheric condition can be selected for the respective decomposition process. Thus, it is possible to carry out the thermal treatment in an inert atmosphere, e.g. argon, under vacuum conditions or reducing atmosphere, which contains e.g. hydrogen, in which for example unnecessary decomposition products are removed.

It is also possible to employ such an open-pored molded body produced according to the invention in the field of (i) filtration, (ii) as catalyst (e.g. in the synthesis of ethylene oxide using an Ag foam catalyst coated with Ag particles), as (iii) electrode material or as (iv) support for a catalytically active substance.

Increasing the specific surface area leads, in the case of application (i), to a better filtration performance since adsorption tendency and capacity are significantly increased.

In application (ii), the increase in the specific surface area leads to a greater than proportional increase in the catalytic activity since not only does the number of active sites increase but the surface also has a distinctly faceted structure. The resulting increased surface energy additionally leads to a significant increase in the catalytic activity compared to the unfaceted surface of the open-pored starting shaped body.

In application case (iii), the increase in the specific surface area likewise leads to an increase at active centers, which in combination with the faceted structure of the surface leads to a significant reduction in the electric overvoltage compared to commercial electrodes (e.g. nickel or carbon). As specific application, mention may also be made of electrolysis, e.g. using Ni or Mo foam coated with Ni particles or Mo particles. In this application in particular, it is also advantageously possible to use sintered and metallic open-pored molded bodies coated on one side with metallic particles since in this case the gradation of the pore size ensures that the gas bubbles are transported away well.

In the case of application (iv), the increase in the specific surface area leads to better adhesion of the active component, e.g. a catalytic washcoat, to the support surface, which significantly increases the mechanical, thermal and chemical stability of a catalyst material.

Suitable metals for particles and semifinished parts to be applied, with which shaped bodies produced according to the invention are producible, are: Ni, Fe, Cr, Al, Nb, Ta, Ti, Mo, Co, B, Zr, Mn, Si, La, W, Cu, Ag, Au, Pd, Pt, Zn, Sn, Bi, Ce or Mg.

Chemical compounds of the metals Ni, Fe, Cr, Al, Nb, Ta, Ti, Mo, Co, B, Zr, Mn, Si, La, W, Cu, Ag, Au, Pd, Pt, Zn, Sn, Bi, Ce, Mg, V which can be converted by chemical reduction, thermal or chemical decomposition in a thermal treatment into particles of the respective metal can be used, in particular, their oxides, nitrides, hydrides, carbides, sulfides, sulfates, phosphates, fluorides, chlorides, bromides, iodides, azides, nitrates, amines, amides, metal-organic complexes, salts of metal-organic complexes, or decomposable salts for the material containing particles, with which the surface of the open-pored shaped body present as semifinished part is to be coated. Particularly suitable chemical compounds are chemical compounds of: Ni, Fe, Ti, Mo, Co, Mn, W, Cu, Ag, Au, Pd or Pt.

In the thermal or chemical decomposition of a chemical compound to give the respective metal, an atmosphere suitable for the decomposition, which can be inert, oxidizing or reducing, is maintained until the thermal or chemical decomposition of the chemical compound into the metal has occurred. For the chemical reduction of a chemical compound to the respective metal, the thermal treatment which is to lead to the chemical reduction can preferably be carried out in a reducing atmosphere, in particular a hydrogen atmosphere, for at least some of the time until the chemical reduction has been carried out.

For a chemical decomposition by means of oxidation, atmospheres containing oxygen, fluorine, chlorine, any mixtures of these gases and also any mixtures with inert gases, for example nitrogen, argon or krypton, are particularly useful.

In a thermal or chemical decomposition of a corresponding chemical compound of a metal forming the particles, an analogous procedure can be employed by maintaining the appropriate atmospheric conditions during the thermal treatment at least until the respective decomposition process has been concluded to a sufficient extent and sufficient metallic particles for the sinter connection on the material of the semifinished part have been obtained as a result of the decomposition.

In the case of a chemical decomposition, metal cations can be reduced to form elemental metals. It is, however, possible to oxidize the anion constituent. A chemical decomposition of a compound of relatively noble metals to give the elemental metals (Au, Pt, Pd) in air, i.e. a comparatively oxidizing atmosphere, is also conceivable. Disproportionations according to the illustrative equation: 2 Gel ↔Ge (s)+Gel (g) are also possible for aluminum, titanium, zirconium and chromium. It is also possible to use crystalline, metal-organic complexes or salts thereof in which the metal center is already in the oxidation state 0.

The surface properties of an open-pored molded body produced according to the invention can be influenced, for example in respect of the heat resistance, the resistance to corrosion, the chemical resistance, the adhesion of a catalytic washcoat and the catalytic function, by means of the metallic particles which have been formed by chemical reduction, thermal or chemical decomposition and are sintered to the surface of the semifinished part. Here, a gradated transition between the metallic material of the semifinished part and the material of the metal particles formed also has an advantageous effect. Different phases can here be formed starting out from the surface through to the struts of the semifinished part, as can also be seen from working examples below.

Porosity, pore size and specific surface area can be substantially influenced by the morphology of the particles used for the coating. To achieve a high specific surface area and a finely porous structure, particles having a small size and a dendritic shape, e.g. electrolyte powders, are advantageous. As a result of their irregular geometry which does not allow a gap-free arrangement, adjacent particles form voids which are partially connected to give channels between contact points and particle bodies. Furthermore, an additional micropore space left behind by the volatile component is formed in the thermal decomposition or chemical decomposition when using particles from a chemical compound. The greater the proportion of, and thus also the volume taken up by, the volatile component of the chemical compound, the higher the proportion of the micropore space in the total pore volume. The use of an oxide having a high oxidation state and consequently a high proportion of oxygen is therefore advantageous for a coating with metal oxide particles. Since the sintering activity of structures increases with increasing specific surface area, the atmosphere, the hold time and the material-dependent sintering temperature are chosen such that the particles sinter to one another and to the semi finished part in a mechanically stable manner without the fine pores being significantly densified.

DETAILED DESCRIPTION OF THE INVENTION

The invention will be illustrated below with the aid of examples.

WORKING EXAMPLE 1

An open-pored shaped body composed of silver as semifinished part having an average pore size of 450 μm, a porosity of 95%, the dimensions 70 mm×63 mm, thickness 1.6 mm, obtained by electrochemical coating of a porous foam composed of polyurethane, was subjected to a thermal treatment to remove the organic components, as in working example 1.

Surfaces of the semifinished part which had been freed of organic components were subsequently coated by spraying with a suspension having the following composition:

48% $Ag_2O$ metal oxide powder <5 μm, 1.5% polyvinylpyrrolidone (PVP) binder 49.5% water as solvent 1% dispersant.

For this purpose, the pulverulent binder was firstly dissolved in water and then all other components were added and mixed in a Speedmixer for 2×30 seconds at 2000 rpm to give a suspension.

The semifinished part was sprayed with the prepared powder suspension a number of times on both sides by a wet powder spraying process. Here, the suspension is atomized in a spraying device and applied to surfaces on both sides of the semifinished part. The suspension is distributed uniformly in the porous network of the semifinished part by the exit pressure from the spray nozzle. The suspension adheres only to the strut surface, so that the struts are completely covered with the suspension and the open porosity of the semifinished part is largely retained. The semifinished part which has been coated in this way was subsequently dried in air at room temperature.

For binder removal, reduction and sintering, a thermal treatment was carried out under a hydrogen atmosphere and subsequently in a furnace. For this purpose, the furnace was heated up at a heating rate of 5 K/min. The reduction of the silver oxide commences at below 100° C. and is concluded at 200° C. and a hold time of about 30 minutes under hydrogen. The remaining binder removal and sintering process can then be carried out in an oxygen-containing atmosphere, e.g. air, in the temperature range from 200° C. to 800° C. at a hold time of from 1 minute to 180 minutes.

During the further thermal treatment, the silver oxide was firstly reduced to metallic silver, which is present in nanocrystalline form. As a result of the remaining binder removal and partial sintering of the then metallic silver particles onto the silver foam struts, the particles grow to form larger and more coarsely crystalline conglomerates, and secondly the Ag also diffuses out from the powder particles into the strut material until the powder particles are firmly joined via sinter necks or sinter bridges which form to the struts of the surface of the open-pored molded body.

After the further thermal treatment, a homogeneous open-pored molded body which is formed by 100% silver is present.

The porosity is about 93%.

The surface of the struts has a high roughness. The reason for this is that the applied powder particles are joined only via sinter necks/sinter bridges to the surfaces of the semifinished part, so that the original particle morphology is retained. The specific internal surface area (measured by the BET method) of the finished open-pored molded body was able to be increased from 10.8 $m^2/l$ initially (uncoated state) to 82.5 $m^2/l$ afterwards (coated state) by means of the process carried out.

WORKING EXAMPLE 2

An open-pored shaped body composed of nickel and having an average pore size of 450 μm, a porosity of about 95%, the dimensions 200 mm×80 mm, thickness 1.6 mm (produced by electrolytic deposition of Ni on PU foam, an $MoS_2$ powder having an average particle size of <60 μm and a mass of 15 g, as B a 1% strength aqueous solution of polyvinylpyrrolidone having a volume of 20 ml was used as semifinished part.

The semifinished part composed of nickel was sprayed with the binder solution on one side, such that the previously open pores are closed on one side by the binder. The semifinished part wetted with the binder is subsequently fixed in a vibration apparatus and sprinkled on the binder-coated side with the $MoS_2$ powder. The pore space near the surface was completely filled by agglomerate formation. Owing to the vibration, the powder was partly also distributed into the interior of the semifinished part. The underside of the semifinished part which had been coated in this way remained uncoated. As a result, the powder loading in the foam is gradated from the upper side to the underside.

The binder removal (removal of the organic components) was carried out in a thermal treatment in an argon atmosphere. For this purpose, the furnace is heated up at a heating rate of 5 K/min. Binder removal commences at about 300° C. and is concluded at 600° C. and a hold time of about 30 minutes. Heating is then continued up to 1100° C. with a hold time of 1 hour at this maximum temperature, with the $MoS_2$ being decomposed into Mo and S and the sulfur in the vapor phase being transported away by the argon gas stream. The atmosphere in the thermal treatment was subsequently changed over from argon to hydrogen and heating-up was continued. The sintering process took place at a temperature of from 1260° C. to and a hold time of 60 min.

During sintering, the Mo diffuses out of the powder particles into the strut material until the powder particles are firmly joined via sinter necks or sinter bridges which form to the struts of the semifinished part. However, complete equalization of the element concentration does not occur.

After this thermal treatment, an open-pored molded body having a gradated porosity and pore size is present. On the side which has previously been wetted with binder and provided with applied powder, the porosity is <30% and the pore size is in the range 5 μm-50 μm and increases continuously to a porosity of 95% and a pore size of 450 μm on the uncoated side of the shaped body.

The molybdenum-coated foam struts have a gradated phase composition as follows:

Composition/phases: Mo (porous layer on the outside of the strut and in the filled pore space)

MoNi (transition region outside)

$MoNi_3$ (transition region central)

$MoNi_4$ (transition region inside)

Ni (interior of strut)

The surface of the struts has a high roughness. The reason for this is that the applied powder particles are joined to the support foam only via sinter necks or sinter bridges, so that the original particle morphology is retained.

WORKING EXAMPLE 3

An open-pored shaped body composed of nickel and having an average pore size of 580 μm, a porosity of about 95%, the dimensions 75 mm×70 mm, thickness 1.9 mm (produced by electrolytic deposition of Ni on PU foam, was used as semifinished part, a $TiH_2$ titanium hydride powder having an average particle size of <45 μm, a mass of 12 g, a stearamide wax having an average particle size of <80 μm, a mass of 0.12 g, was used as powder, and a 1% strength aqueous solution of polyvinylpyrrolidone having a volume of 20 ml was used as binder.

Powder and stearamide wax were mixed for 10 minutes using a Turbula mixer.

The semifinished part was sprayed on both sides with the binder solution. It was subsequently fixed in a vibration apparatus and sprinkled on both sides with the titanium hydride powder. As a result of the vibration, the powder is distributed in the porous network of the semifinished part. The coating with binder and powder was repeated five times, so that the pore spaces had been completely filled. The semifinished part which had been treated in this way was subsequently dried at room temperature in air.

Binder removal was carried out under hydrogen atmosphere conditions. For this purpose, the furnace is heated up at a heating rate of 5 K/min. Binder removal commences at about 300° C. and is concluded at 600° C. and a hold time at this temperature of about 30 minutes. The decomposition of the titanium hydride into hydrogen and titanium was then carried out in the thermal treatment under vacuum conditions at 700° C. and a hold time of 60 minutes. This was followed by further heating up to the sintering temperature of 900° C. at a hold time of 30 minutes.

After the thermal treatment which led to sintering, the struts of the semifinished part which had been coated with titanium hydride has a gradated phase composition, as follows:

Composition/phases: Ti (porous layer on the outside of the strut and in the filled pore space)

$Ti_2Ni$ (transition region outside)

TiNi (transition region central)

$TiNi_3$+TiNi (transition region inside)

Ni (strut interior)

The porosity of the open-pore molded body which had been treated in this way is 48% and the specific surface area is 55 $m^2/l$.

The invention claimed is:

1. A process for producing open-pored molded bodies having a modified surface comprising metal, sequential steps of coating on a surface with particles on an open-pored shaped body comprising a semifinished metal part with the particles of a chemical compound of a metal having a dentritic shape which is reduced or thermally or chemically decomposed in a thermal treatment to form metal particles of a size between 0.1 μm to 250 μm of the respective metal obtained by chemical reduction or thermal or chemical decomposition;

and then the coating on the surface with the metal particles is followed by at least one thermal treatment in which the metal particles of the respective metal are sintered and solely joined by sinter bridges to the surface of the semifinished metal part or adjacent the metal particles of the respective metal so that a specific surface area of the open-pored shaped body, having a pore size of not more than 10,000 times the metal particle size, obtained is increased to at least 30 $m^2/l$ or by at least a factor of 5 compared to an uncoated semifinished metal part.

2. The process as claimed in claim 1, wherein the particles of the chemical compound of a metal are powder, powder mixture or suspension/dispersion.

3. The process as claimed in claim 1, wherein the coating on a surface with the particles of the chemical compound of the respective metal in the form of a powder, a powder mixture or a suspension/dispersion is carried out by dipping or spraying, in a pressure-assisted manner, electrostatically or magnetically.

4. The process as claimed in claim 1, wherein an organic or inorganic binder is used in solution, suspension/dispersion or as a powder to improve the adhesion of the particles of the chemical compound of the respective metal.

5. The process as claimed in claim 1, wherein the coating on a surface with particles of the chemical compound of the respective metal is repeated.

6. The process as claimed in in claim 1, wherein a binder is used during multiple coating with particles of the chemical compound of the respective metal and the use of the binder is repeated.

7. The process as claimed in claim 1, wherein a binder is used when the coating of the particles of the chemical compound of the respective metal is carried out on different surface sides of the surface of the semifinished metal using different amounts of the respective metal, so that a different porosity, pore size or specific surface area is obtained on the different surface sides.

8. The process as claimed in claim 1, wherein Ni, Fe, Cr, Al, Nb, Ta, Ti, Mo, Co, B, Zr, Mn, Si, La, W, Cu, Ag, Au, Pd, Pt, Zn, Sn, Bi, Ce or Mg is used as the respective metal for the semifinished metal part and the particles of the respective metal to be applied or a chemical compound of Ni, Fe, Cr, Al, Nb, Ta, Ti, Mo, Co, B, Zr, Mn, Si, La, W, Cu, Ag, Au, Pd, Pt, Zn, Sn, Bi, Ce or Mg, is used as the respective metal for a reducible, thermally or chemically decomposable compound.

9. The process as claimed in claim 1, wherein a semifinished metal part obtained by electrochemical coating of an open-pored body of a polymeric material with the respective metal is used.

* * * * *